US010821761B1

(12) United States Patent
Pattekar et al.

(10) Patent No.: US 10,821,761 B1
(45) Date of Patent: Nov. 3, 2020

(54) NON-CONTACT THERMAL PRINTING OF COLOR THERMOCHROMIC MATERIALS

(71) Applicant: Palo Alto Research Center Incorporated, Palo Alto, CA (US)

(72) Inventors: Ashish Pattekar, Cupertino, CA (US); Palghat S. Ramesh, Pittsford, NY (US); Antonio Williams, Palo Alto, CA (US); Joerg Martini, San Francisco, CA (US)

(73) Assignee: Palo Alto Research Center Incorporated, Palo Alto, CA (US)

( * ) Notice: Subject to any disclaimer, the term of this patent is extended or adjusted under 35 U.S.C. 154(b) by 0 days.

(21) Appl. No.: 16/704,396

(22) Filed: Dec. 5, 2019

Related U.S. Application Data

(63) Continuation-in-part of application No. 16/382,884, filed on Apr. 12, 2019, now Pat. No. 10,717,299.

(51) Int. Cl.
*B41J 2/475* (2006.01)
*B41M 5/30* (2006.01)

(52) U.S. Cl.
CPC ..... *B41M 5/30* (2013.01); *B41J 2/4753* (2013.01)

(58) Field of Classification Search
CPC ..... B41J 2/4753; B41J 2/442; B41J 2/3354; B41J 2/447; B41J 11/002; B41M 5/30; B41M 2/38; B41M 5/0011; B41M 5/282
See application file for complete search history.

(56) References Cited

U.S. PATENT DOCUMENTS

| | | | | |
|---|---|---|---|---|
| 8,842,145 | B2 | 9/2014 | Cridland et al. | |
| 9,475,307 | B2 | 10/2016 | Cridland | |
| 10,583,678 | B1 * | 3/2020 | Pirmoradi | B41J 2/32 |
| 2008/0318154 | A1 | 12/2008 | Wyres | |
| 2012/0104743 | A1 * | 5/2012 | Mehta | C09D 11/50 283/95 |

OTHER PUBLICATIONS

Montazeri et al., "Microheater array powder sintering: A novel additive manufacturing process", Journal of Manufacturing Processes 31 (2018), pp. 536-551.
Uyhan et al., "Modelling of thermal printers", Applied Mathematical Modelling 32 (2008), pp. 405-416.

* cited by examiner

*Primary Examiner* — Lamson D Nguyen
(74) *Attorney, Agent, or Firm* — Muerting Raasch Group

(57) ABSTRACT

A system includes an unpatterned heater configured to pre-heat a thermochromic coating disposed on a substrate to a first temperature. The thermochromic coating has a threshold temperature at which the thermochromic material undergoes a color change. The system also includes a patterned heater comprising multiple heating elements configured to heat selected pixels of the thermochromic coating to a temperature at or above the threshold temperature according to a predetermined pattern. An air gap is maintained between the multiple heating elements and the thermochromic material while the patterned heater is heating the thermochromic material. The air in the air gap heated to a second temperature.

20 Claims, 8 Drawing Sheets

NON-CONTACT THERMAL PRINTING OF COLOR THERMOCHROMIC MATERIALS

RELATED PATENT DOCUMENTS

This application is a continuation-in-part of U.S. patent application Ser. No. 16/382,884 filed on Apr. 12, 2019, which is incorporated by reference herein in its entirety.

TECHNICAL FIELD

The disclosure relates to systems and methods for processing thermochromic materials.

BACKGROUND

Thermochromic materials change color in response to exposure to temperature. Thermochromic inks can be applied to relatively larger areas on a substrate by a number of printing or coating processes such as lithography, flexography, gravure, screen printing, and spreading with film applicators. After coating or printing the larger areas with the thermochromic material, the areas are exposed to heat and/or light to produce a color change in precisely controlled regions.

State of the art thermal printing systems for printing of thermochromic materials/coatings which may be used for printing on thermal paper such as Point of Sale (POS) receipt printers rely on using a contact-based approach, wherein an array of heater elements in a thermal printhead is used to locally heat individual 'pixels' on the substrate via contact, for creating the desired text/pattern.

Contact based thermal printing may be undesirable in certain high-volume production applications due to the associated maintenance requirements. The wear and tear, periodic cleaning, and overall maintenance needs of the contact thermal print-heads that undergo constant friction with the print media can result in down-times and costs what are unacceptable in a high volume application environment. In these applications, a non-contact approach may be preferable, which would avoid the constant scraping action between the printhead heater element array and the thermochromic material coated substrates by maintaining a small gap between the heater elements and the substrate, and relying on conduction/convection of the thermal energy through the gap in order to print the desired images. In lower-volume applications, the non-contact approach is also desirable because it also extends the life of the printhead and therefore improves the maintenance costs.

BRIEF SUMMARY

According to some embodiments, a system includes an unpatterned heater configured to pre-heat a thermochromic coating disposed on a substrate to a first temperature. The thermochromic coating has a threshold temperature at which the thermochromic material undergoes a color change. The system also includes a patterned heater comprising multiple heating elements configured to heat selected pixels of the thermochromic coating to a temperature at or above the threshold temperature according to a predetermined pattern. An air gap is maintained between the multiple heating elements and the thermochromic material while the patterned heater is heating the thermochromic material. The air in the air gap heated to a second temperature.

Some embodiments are directed to a method that involves pre-heating a substrate having a thermochromic coating disposed thereon to a first temperature. The thermochromic coating has a threshold temperature at which the thermochromic material undergoes a color change. An air gap between the thermochromic coating and a patterned heater is heated to a second temperature. The patterned heater is operated to heat the pre-heated thermochromic coating above the threshold temperature according to a predetermined pattern.

BRIEF DESCRIPTION OF DRAWINGS

FIG. 5 is a graph of optical density of thermochromic material with respect to air gap distance obtained using non-contact thermal imaging approaches described herein;

The figures are not necessarily to scale. Like numbers used in the figures refer to like components. However, it will be understood that the use of a number to refer to a component in a given figure is not intended to limit the component in another figure labeled with the same number.

DETAILED DESCRIPTION OF ILLUSTRATIVE EMBODIMENTS

Figure 1:
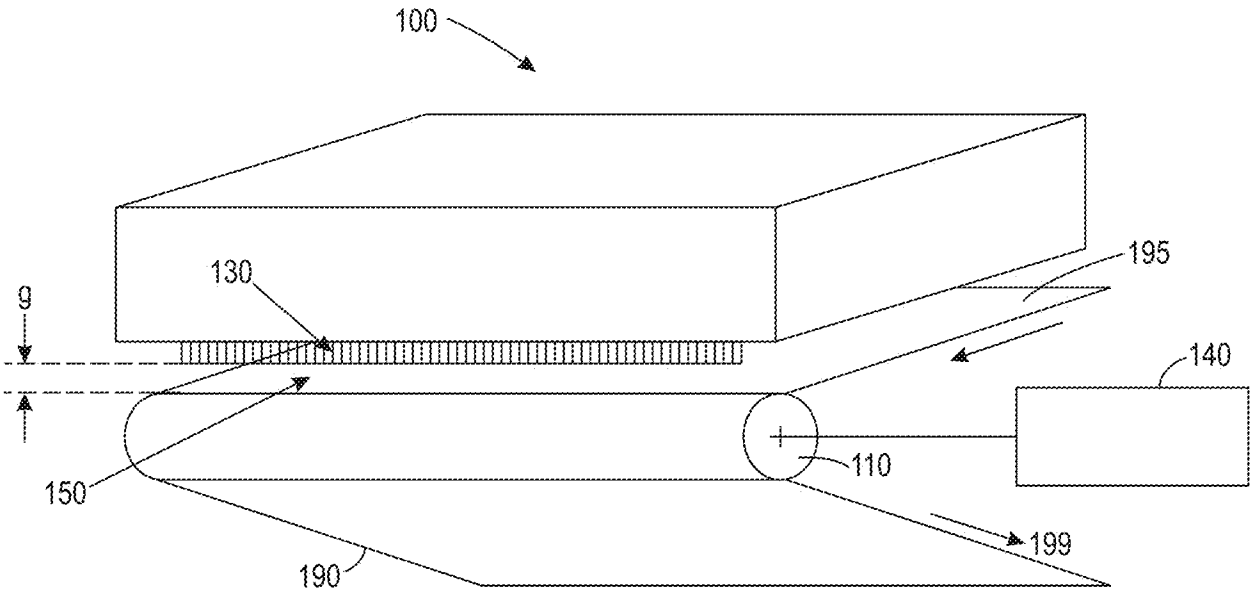
FIG. 1 is a conceptual block diagram of a thermochromic imaging system in accordance with some embodiments.

Non-contact printing is desirable to avoid the wear and tear, periodic cleaning, and overall maintenance needs of contact thermal print-heads that undergo constant friction with the print media. However, air gaps between the heater elements and the substrate results in rapid loss of heating effectiveness. The resolution and print speed capability with an air gap greater than a few micrometers degrades to below commercially viable levels. At the same time, maintaining an air gap less than a couple of micrometers is very challenging from a practical point of view, as the roughness of the substrates and any other microscopic dirt/debris that may be present in the environment (e.g., aerosolized food/oil particles in a restaurant setting) can make it difficult to maintain such a precise and clean air gap to enable the desired contact-less thermal printing.

The approaches described herein enable reliable non-contact thermal printing with relatively large air gaps of up to 20 micrometers, e.g., between about 5 μm and about 20 μm. The disclosed approaches involve pre-heating the substrate upon which the thermochromic coating is disposed and heating the air in the gap between the thermochromic coating and the heating elements. In some embodiments the substrate heating and air gap heating is implemented such that the thermochromic material is maintained at a temperature just below its threshold temperature.

The thermal substrate on which the print patterns are formed is typically coated with a thermochromic material that changes color (or lightness/darkness) in response to a change in temperature. An example of such a coating is a solid-state mixture of a dye and a suitable matrix, e.g., a combination of a fluoran leuco dye and an octadecylphosphonic acid. When the coating is heated above its melting point, the dye reacts with the acid, shifts to its colored form, and the changed form is then conserved in metastable state when the matrix solidifies back quickly enough (a process known as thermochromism).

The temperature at which the thermochromic material changes color is referred to as its threshold temperature. The threshold temperature is a temperature at which a color change is first detectable. A color change with full color saturation can be achieved by exposing the thermochromic material to a temperature at or above its threshold temperature for a predetermined time duration. The saturation level of the thermochromic material can be modulated by exposing the thermochromic material for shorter periods of time, and/or to lower temperatures that are above the threshold temperature. For some thermochromic materials, the threshold temperature may be about 80 degrees C.

Types of thermochromic materials useful for the embodiments disclosed herein include diacetylene ethers and homopolymers thereof, as described, for example, in U.S. Pat. No. 5,149,617 which is incorporated herein by reference. Several other types of thermochromic materials may be suitable including a) Copper(I) iodide which is a solid tan-gray (or white) material at room temperature, transforming at 60-62° C. to orange color; b) Ammonium metavanadate which is a white material, turning to brown at 150° C. and then to black at 170° C.; and c) Manganese violet (Mn(NH4)2P2O7) which is a violet material, a popular violet pigment, that turns white at 400° C. Note that this is not an exhaustive list and other materials may be used in conjunction to the disclosed approaches.

The approaches disclosed herein are directed to systems and methods for image formation based on thermochromic materials. The thermochromic material is first pre-heated to a temperature below the threshold temperature. After or concurrently with the pre-heating of the thermochromic material to the sub-threshold temperature, areas of the thermochromic material are exposed to patterned energy dosages that result in local heating to above the threshold temperature according to a predetermined pattern, e.g., text, images, or other two dimensional graphics.

FIG. 1 is a conceptual block diagram of an imaging system 100 in accordance with some embodiments. The imaging system 100 includes an unpatterned heater 110 shown as a heated roller configured to pre-heat the substrate 190 which transfers heat to a thermochromic coating 195 disposed thereon. The unpatterned heater 110 delivers unpatterned heat energy to the substrate 190, e.g., heat energy that is substantially consistent across the surface of the substrate. Although shown as a heated roller in FIG. 1, the unpatterned heater may comprise any type of contact or non-contact heater, such as radiant heater, a resistive heater, an infrared lamp, etc. The temperature of the first heater 110 may be below the threshold temperature of the thermochromic material, or may exceed the threshold temperature in some embodiments. The overall heat transfer from the unpatterned heater 110 to the thermochromic coating is maintained by the system such that the temperature of the thermochromic coating remains below its threshold temperature. The heating rate, heating time, and/or temperature of the unpatterned heater 110 may be controlled using a closed-loop control system (not shown) that is set up such that the appropriate below-threshold temperature of the thermochromic coating 195 is achieved at the desired speed of movement ("print speed") of the substrate 190 through the imaging system 100.

After or concurrently with the pre-heating of the thermochromic coating 195 by the unpatterned heater 110, a patterned heater 130, e.g., a one- or two-dimensional spatially patterned heat source, is configured to expose selected pixels or areas of the pre-heated thermochromic coating to an energy dosage according to a predetermined pattern. The thermochromic coating 195 may include multiple pixels and the predetermined pattern dictates the energy dosage to which individual pixels are exposed to. The energy dosages involve heating selected pixels to predetermined temperatures at or above the threshold temperature of the thermochromic material for predetermined times that cause changes in the colors of the pixels according to the predetermined pattern. For example, a non-selected set of pixels of the thermochromic coating may be not be exposed to an energy dosage above the threshold dosage; a first set of selected pixels of the thermochromic coating may be exposed to a first energy dosage comprising a first temperature above the threshold temperature for a first period of time; a second set of selected pixels may be exposed to a second energy dosage comprising a second temperature above the threshold temperature for a second period of time. According to some embodiments, one or both of the first temperature and the second temperature are within about 25% of the threshold temperature.

The non-selected pixels that are not exposed to an energy dosage from the patterned heat source do not heat up above the threshold temperature and thereby remain colorless. The first energy dosage causes the first set of pixels change color and attain a first color saturation level. The second energy dosage causes the second set of pixels to change color and attain a second color saturation level. Although this example refers to first and second sets of selected pixels that are exposed to first and second dosages, it will be appreciated that the predetermined pattern may involve more than two sets of pixels that are respectively exposed to different energy dosages and thereby attain more than two different temperatures above the threshold temperature which result in more than two resulting color saturation levels.

In many embodiments, the patterned heater may be a resistive heater, wherein individual heating elements corresponding to the pixels are heated by a current flowing through the resistive heating elements.

The heating elements of the patterned heater 130 do not contact the surface of the thermochromic coating 195. An air gap 150 is maintained between the multiple heating elements 130*a*, 130*b* and the thermochromic material 195 while the patterned heater 130 is heating the thermochromic material 195 to a second temperature that is above the threshold temperature. The air gap 150 may be up to 20 μm, e.g., between about 5 μm and about 20 μm, for example.

As shown in FIG. 1, in some embodiments, the substrate 190 comprises an elongated web or film having the thermochromic coating 195 disposed thereon. A movement mechanism 140, illustrated in FIG. 1 as a motor driven pinch roller, moves the elongated substrate 190 through the system. For example, the movement mechanism 140 may move the elongated substrate 190 at print speeds up to about 4 m/s. At these speeds, significant energy demands are placed on the patterned heater 130 to keep up with the high-speed patterned heating requirements. Pre-heating the thermochromic material using the unpatterned heater 110 and heating the air gap 150 reduces the energy requirements of the patterned heater 130.

As discussed above, the unpatterned heater 110 may comprise at least one rotating heated roller or drum that comes in contact or in close proximity with the elongated film 190 as a movement mechanism 140 moves the elongated film 190 along the direction indicated by arrow 199. The roller 110 may be heated to any temperature so long as the effect of the heating results in achieving a temperature of the thermochromic coating 195 that is close to, but below the threshold temperature. For example, the roller 110 may be heated such that the movement of the thermochromic material in conjunction with the heating of the substrate achieves a temperature of the thermochromic coating that is below the threshold temperature. e.g., 10 degree C., 5 degree C. or even less than 5° C. below the threshold temperature. For example, in some configurations the heated roller 110 may be heated to a temperature higher than the threshold temperature of the thermochromic coating 195. However, the movement of the film 190 is controlled such that dwell time of the thermochromic coating 195 over the heated roller 110 is brief and thus the thermochromic coating 195 is not heated to above the threshold temperature.

Figure 2:
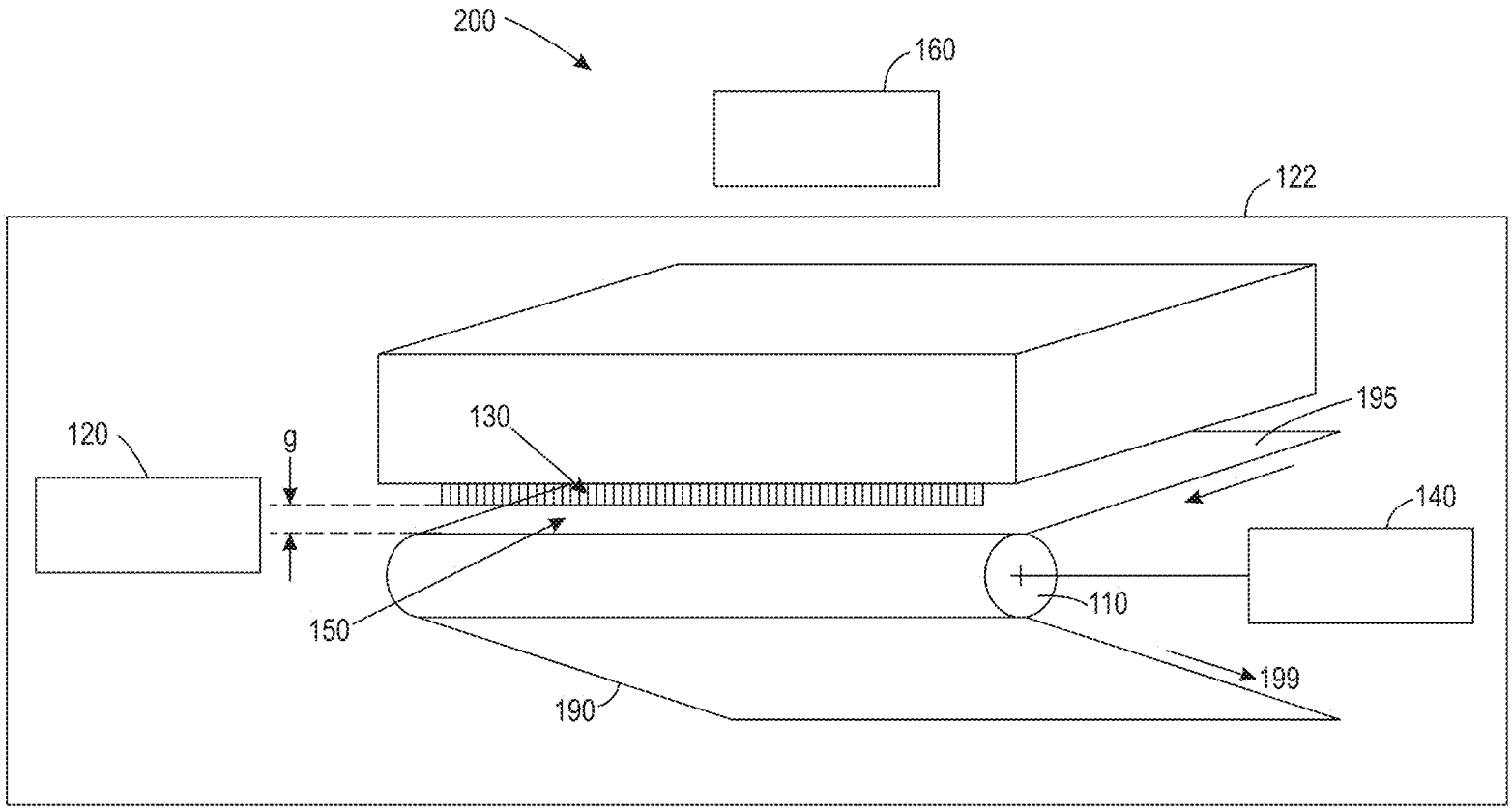
FIG. 2 is a conceptual block diagram of a thermochromic imaging system that includes an air gap heater in accordance with some embodiments.

FIG. 2 illustrates another embodiment of an image system 200 in accordance with some embodiments. In addition to the unpatterned heater 110, the patterned heater 130, and the other components discussed above, the image system 200 includes a gap heater 120 that is configured to pre-heat the air in the air gap 150. The air gap heater 120 may comprise any type of suitable type of heater such as a forced air heater, a radiant heater, etc.

According to some implementations, operation of the unpatterned heater 110 in conjunction with the air gap heater 120 pre-heats the thermochromic coating 195 to a temperature below the threshold temperature of the coating 195. In this implementation, the thermochromic coating 195 does not exhibit a color change in response to the sub-threshold temperature resulting from the heating effect delivered by the unpatterned heater 110 and the air gap heater 120.

The unpatterned heater 110 and the air gap heater 120 may be set to different temperatures or to the same temperature. For example, in some embodiments, the unpatterned heater 110 may be thermostatically controlled such that it is heated to a first temperature. The air gap heater 120 may be thermostatically controlled such that the temperature of the air in the air gap 150 is controlled to a second temperature different from, e.g., higher or lower, than the temperature of the unpatterned heater 110. In some embodiments, the unpatterned heater 110 may be set to the same temperature as the air gap heater 120. In various embodiments, one or both of the temperature of the heating element of the first heater 110 and the air temperature produced by the second heater 120 may be within 25%, 20%, 15%, 10%, 5%, or even 1% of the threshold temperature of the thermochromic coating 195.

Optionally either imaging system 100, 200 may include an enclosure 122 that includes one or more openings that allow the elongated substrate 190 having the thermochromic coating 195 disposed thereon to enter and exit the enclosure 122. The enclosure may be employed to aid in keeping the temperature of the air in the air gap more uniform which in turn will keep the temperature of the thermochromic coating 195 more uniform. The entrance and exit openings may have air control features as discussed in commonly owned U.S. patent application Ser. No. 16/382,884 which has been incorporated by reference herein.

According to some aspects, the system 100, 200 may include a controller 160 that controls and coordinates the operation of the unpatterned heater 110, the optional air gap heater 120, the patterned heater 130, and/or the movement mechanism 140.

Figure 3:
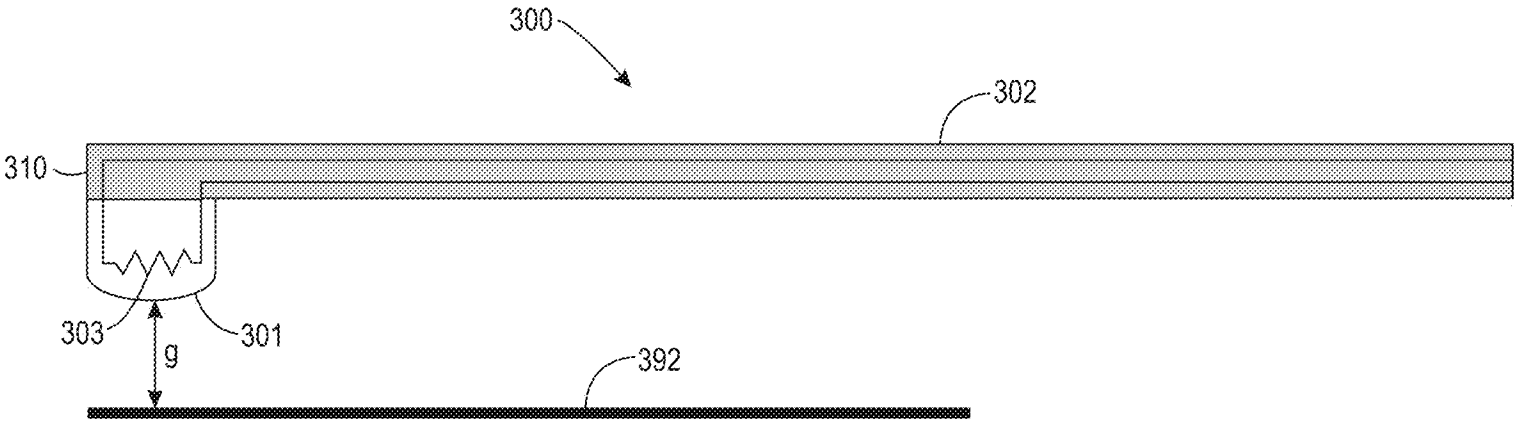
FIG. 3 illustrates a heating element of a patterned heater in accordance with some embodiments.

In some configurations, the patterned heater 300 may comprise multiple heating elements 310, each heating element comprising a heating head 301 suspended on a flexure arm 302 as illustrated in FIG. 3. In the implementation illustrated in FIG. 3, the heating head 301 includes a resistive heating element 303. Each of the heating elements 310 may be floating in a way analogous to a floating disk drive read/write head. Each floating heating head flys above the substrate at a flying height that defines the air gap distance, g. In some embodiments, the flying height may be equal to the air gap distance, g, which is the distance between the heating head 301 and the substrate having the thermochromic coating disposed thereon 392. The heating element may comprise a linear array of flexures and heating heads that can be made using microfabrication. Either forced air heated to just below the threshold temperature of the thermochromic material, or the air from the moving substrate which is heated to just below the threshold temperature could be used to maintain the air gap between the heater and substrate.

Figure 4:
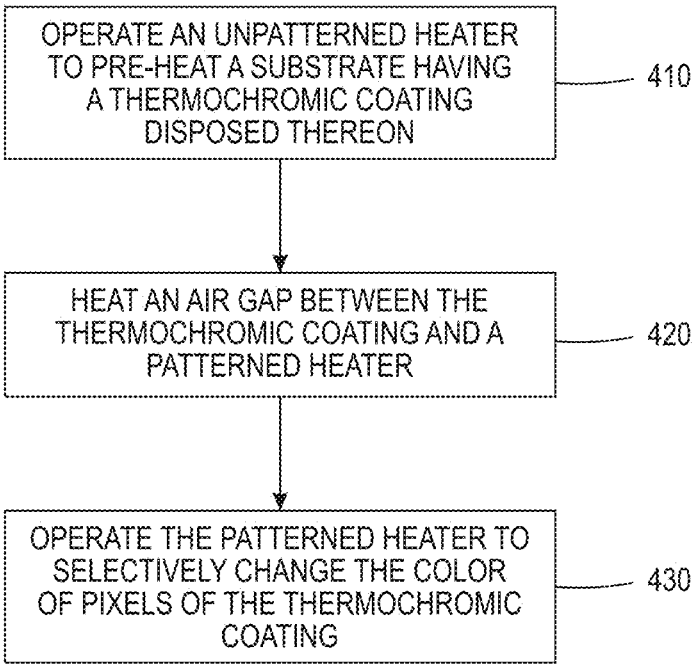
FIG. 4 is a flow diagram of a method of thermochromic imaging in accordance with some embodiments.

FIG. 4 is a flow diagram that illustrates operation of the system of FIGS. 1-3. The process involves operating 410 an unpatterned heater to pre-heat a substrate having a thermochromic coating disposed thereon to a first temperature wherein the thermochromic coating has a threshold temperature at which the thermochromic material undergoes a color change. The air gap between the thermochromic coating and a patterned heater is heated 420 to a second temperature. The patterned heater is operated 430 to heat the pre-heated thermochromic coating above the threshold temperature of the according to a predetermined pattern. According to some embodiments, the unpatterned heater may contact the substrate and the patterned heater may be a non-contact heater, e.g., a resistive heater.

Example 1

Figure 5:
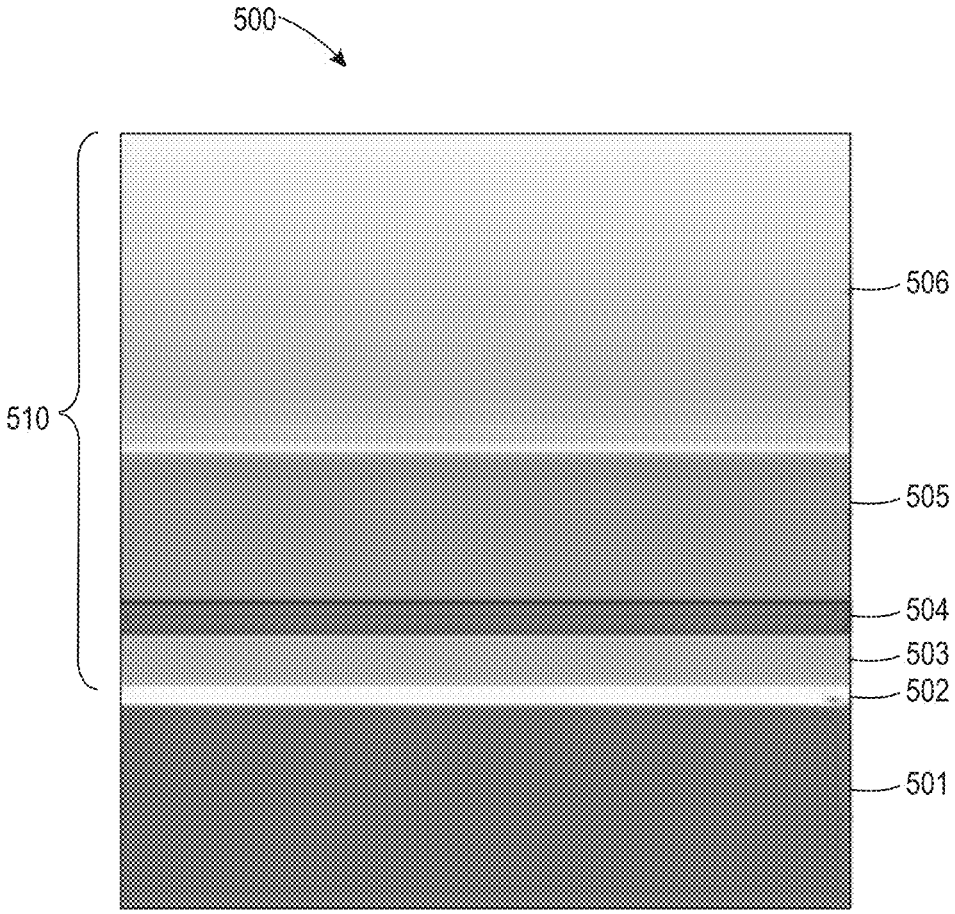
FIG. 5 is a stack used to model the thermal characteristics of a system in accordance with embodiments described herein.

Thermal simulations were performed to determine the feasibility of noncontact thermal printing across an air gap of up to 20 micrometer using the disclosed approaches. The stack used in the model setup is illustrated in FIG. 5. The thermal model used was a two dimensional model that includes lateral heat flow in the heater layer to gold leads. In this experiment, multiple pixels were heated during a cycle time. During each cycle time the voltage to the heaters was pulsed and the heaters were allowed to cool down before the next cycle. This process allows for the temperatures of the heaters to decay below the development onset for the next cycle (pixel). Heater temperatures and flow of heat to the substrate depends on the details of the construction (material layers, dimensions), and heater pulse width during a cycle. In addition, history control is frequently used, which allows for the heating during a cycle to be adjusted based on previous cycles, to maintain heater temperatures cycle to cycle. The thermal cycle $T_{cycle}$=pixel_size/U, where pixel_size is the pixel size in $\mu m^2$ and U is the substrate speed. The pulse time for driving the heater, pulse_time=$0.5\times T_{cycle}$.

The heater is designed to provide a total heating power of approximately 95 W/mm$^2$ when it is turned on, and each heating element is 80 micron×40 micron in size—resulting a per pixel heating power of 0.304 W in the on state.

Figure 6:
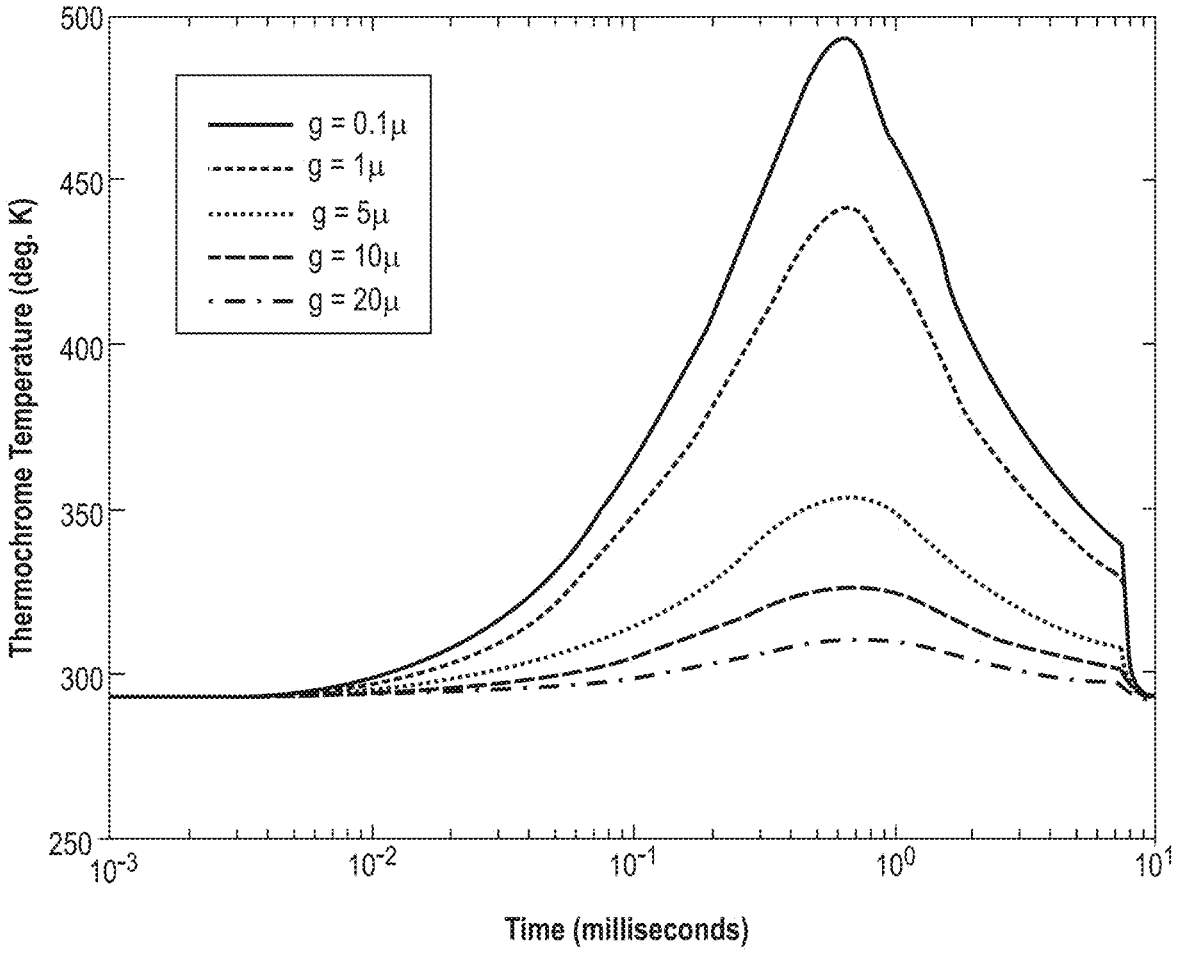
FIG. 6 is a graph showing the temperatures in degrees K of the thermochromic coating for air gaps distances of g=0.1 μm, 5 μm, 10 μm, and 20 μm when the stack heater can provide a heating rate (power) of 94.54 W/mm2 and the coated substrate is moving at a speed of 0.05 m/s in accordance with a first example.
Figure 7:
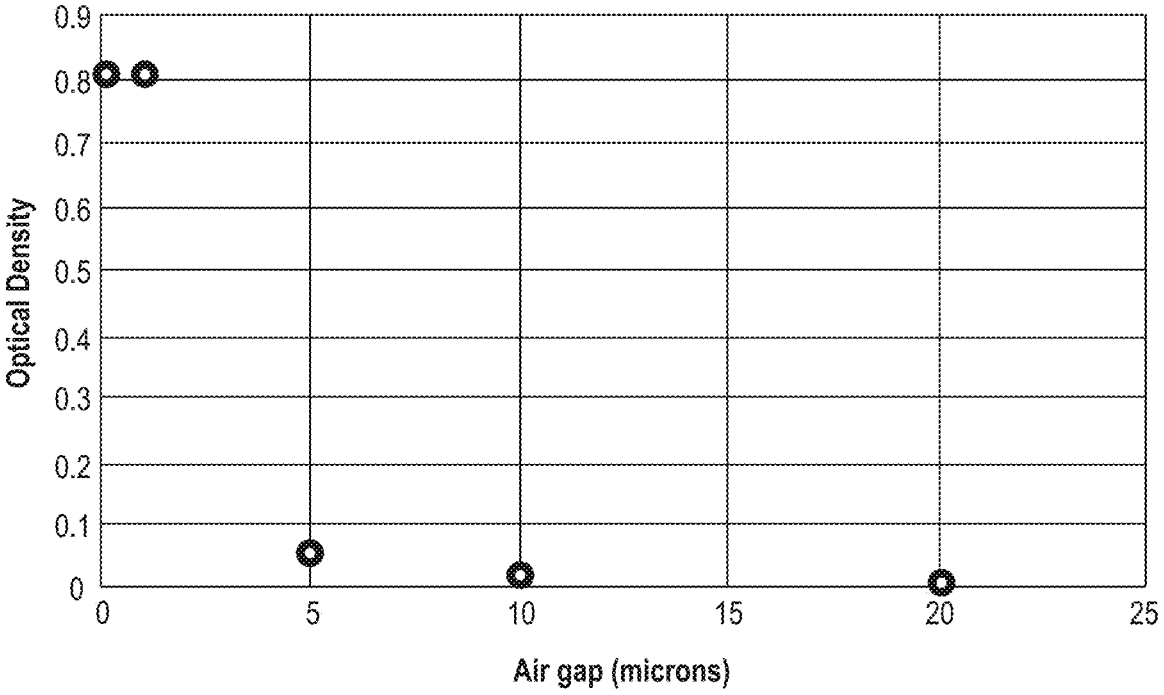
FIG. 7 shows optical density of the thermochromic material, which is a measure of color saturation, as a function of air gap distance, g.

The thermal model assumes a stack 500 comprising a substrate 501 separated from the heating assembly 510 by an air gap 502 of 0 to 20 μm. The heating assembly 510 comprises an SiO2 layer 503; a resistive heating layer 504 having a thickness of about 1.5 μm; a layer 505 of glass having a thickness of about 45 μm; and a thermally conductive heat sink layer 506. Example 1 modeled an unpatterned heating layer without an air gap heater. FIG. 6 is a graph showing the temperatures in degrees K of the thermochromic coating for air gaps distances of g=0.1 μm, 1 μm, 5 μm, 10 μm, and 20 μm when the stack heater is turned on and is moving at a speed of 0.05 m/s. FIG. 6 shows that the temperatures achieved in the thermochromic coating with air gap distances of 5 μm, 10 μm, and 20 μm would be less than a thermochromic threshold temperature of 80 degrees C. for typical thermochromic material. FIG. 7 shows optical density of the thermochromic material, which is a measure of color saturation, as a function of air gap distance, g. FIG. 7 also shows that the optical density is substantially decreased for g>1 μm in this experiment. In this example, it was demonstrated that any air gap greater than 1 μm with room temperature air in the air gap leads to a rapid loss of temperature at the substrate surface, and therefore an inability to print/image using the thermochromic coatings.

Example 2

Figure 8:
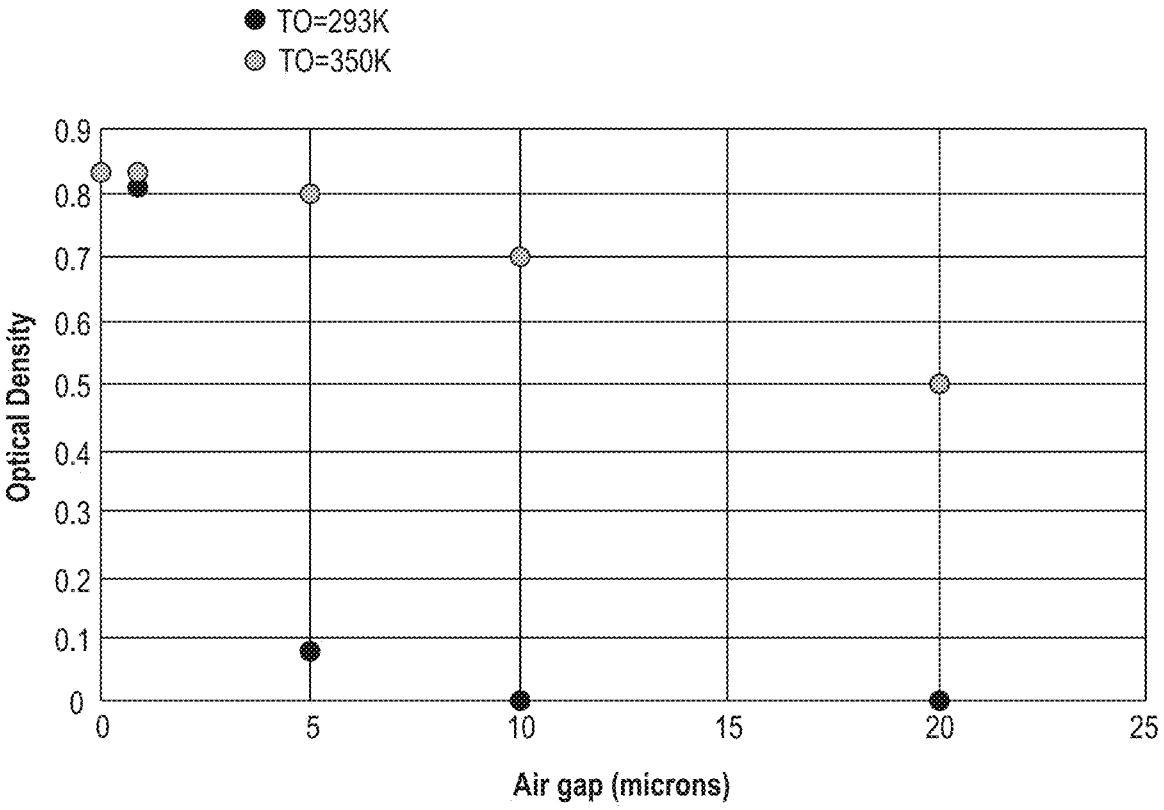
FIG. 8 is a graph of the optical density of the thermochromic material with respect to air gap, g, when the stack heater can provide a heating rate (power) of 94.54 W/mm2 and the air gap air is heated to 77 degrees C.

The same model as discussed above was used with the variation that the ambient air in the gap was heated to 77 degrees C. (=350 K), which is just below the threshold temperature of 80 degrees C. for typical thermochromic material coated substrates. In this scenario, it was shown that an air gap of up to 20 micrometer is possible, with a relatively small loss in printing darkness (optical density) of the resulting print. FIG. 8 is a graph of the optical density with respect to air gap, g. FIG. 8 superimposes the data from FIG. 7 and the data obtained from the experiment in which the air gap air was heated to 77 degrees C.

Various modifications and alterations of the embodiments discussed above will be apparent to those skilled in the art, and it should be understood that this disclosure is not limited to the illustrative embodiments set forth herein. The reader should assume that features of one disclosed embodiment can also be applied to all other disclosed embodiments unless otherwise indicated. It should also be understood that all U.S. patents, patent applications, patent application publications, and other patent and non-patent documents referred to herein are incorporated by reference, to the extent they do not contradict the foregoing disclosure.

The invention claimed is:

1. A system comprising:

an unpatterned heater configured to pre-heat a thermochromic coating disposed on a substrate to a first temperature, the thermochromic coating having a threshold temperature at which the thermochromic material undergoes a color change;

a patterned heater comprising multiple heating elements configured to heat selected pixels of the thermochromic coating to a temperature at or above the threshold temperature according to a predetermined pattern; and an air gap maintained between the multiple heating elements and the thermochromic material while the patterned heater is heating the thermochromic material, air in the air gap heated to a second temperature.

2. The system of claim 1, further comprising a movement mechanism configured to move the substrate having the thermochromic material disposed thereon relative to the multiple heating elements.

3. The system of claim 2, wherein each heating element is suspended on a flexure arm that floats above the thermochromic material.

4. The system of claim 1, wherein the gap is between about 5 μm and 20 μm.

5. The system of claim 1, wherein the air is heated by the unpatterned heater.

6. The system of claim 1, wherein the unpatterned heater comprises one or more of a rotating heated drum, an infrared heater, and a resistive heater.

7. The system of claim 1, further comprising an air gap heater configured to heat the air in the air gap to a second temperature.

8. The system of claim 7, wherein the air gap heater comprises one or more of an infrared heater and a forced air heater.

9. The system of claim 7, wherein one or both of the first temperature and the second temperature is within 25% of the threshold temperature.

10. The system of claim 1, wherein:

the substrate comprises an elongated film;

the unpatterned heater comprises a rotating drum that comes in contact with the elongated film.

11. The system of claim 1, wherein the thermochromic material comprises a fluoran leuco dye.

12. The system of claim 1, wherein the multiple heating elements of the patterned heater are resistive heating elements.

13. A method, comprising:

pre-heating a substrate having a thermochromic coating disposed thereon to a first temperature, the thermochromic coating having a threshold temperature at which the thermochromic material undergoes a color change;

heating an air gap between the thermochromic coating and a patterned heater to a second temperature; and operating the patterned heater to heat the pre-heated thermochromic coating above the threshold temperature according to a predetermined pattern.

14. The method of claim 13, wherein pre-heating the substrate comprises bringing the substrate near or in contact with a heated rotating drum.

15. The method of claim 13, wherein the air gap is heated by heat transfer from the pre-heated substrate.

16. The method of claim 13, wherein the air gap is heated by at least one of a forced air and an infrared heater.

17. The method of claim 13, wherein the air gap is between 5 μm and 20 μm.

18. The method of claim 13, wherein one or both of the first temperature and the second temperature is less than the threshold temperature.

19. The method of claim 13, wherein the patterned heater comprising multiple resistive heating elements.

20. The method of claim 13, wherein one or both of the first temperature and the second temperature is within 25% of the threshold temperature.

* * * * *